US007255338B2

(12) United States Patent
Wilfer et al.

(10) Patent No.: US 7,255,338 B2
(45) Date of Patent: Aug. 14, 2007

(54) METHOD AND APPARATUS FOR PROCESSING SHEET MATERIAL

(75) Inventors: Kurt Wilfer, Oberschleissheim (DE); Alexander Steinkogler, Munich (DE)

(73) Assignee: Giesecke & Devrient GmbH, Munich (DE)

( * ) Notice: Subject to any disclaimer, the term of this patent is extended or adjusted under 35 U.S.C. 154(b) by 1064 days.

(21) Appl. No.: 10/132,199

(22) Filed: Apr. 26, 2002

(65) Prior Publication Data

US 2002/0158397 A1 Oct. 31, 2002

(30) Foreign Application Priority Data

Apr. 27, 2001 (DE) ..... 101 20 904

(51) Int. Cl.
*B65H 5/00* (2006.01)

(52) U.S. Cl. ..... 271/10.03; 271/4.03; 271/258.01; 271/3.17

(58) Field of Classification Search ..... 271/10.03, 271/3.17, 4.03, 258.01; 270/58.33, 52.02; 414/798.2; 209/534; 235/379; 382/135, 382/136, 137, 138, 139, 140
See application file for complete search history.

(56) References Cited

U.S. PATENT DOCUMENTS 3,652,078 A * 3/1972 Sather et al. ..... 270/52.06
4,025,420 A * 5/1977 Horino ..... 209/534
4,555,103 A * 11/1985 Larson ..... 271/35
4,925,176 A 5/1990 Acquaviva
4,934,685 A * 6/1990 Shifley ..... 271/35
4,939,888 A * 7/1990 Katz et al. ..... 53/411
5,022,531 A * 6/1991 Horino et al. ..... 209/552
5,103,982 A 4/1992 Walter et al.
5,364,085 A * 11/1994 Kennish ..... 270/58.02
5,575,463 A * 11/1996 Parkander ..... 270/52.02
5,917,930 A * 6/1999 Kayani et al. ..... 382/135
5,947,461 A * 9/1999 Holbrock ..... 270/52.09
6,244,584 B1 * 6/2001 Holbrook et al. ..... 271/3.07
6,502,812 B2 * 1/2003 Belec ..... 270/52.02
6,615,105 B2 * 9/2003 Masotta ..... 700/219
2002/0040865 A1 4/2002 Steinkogler et al.

FOREIGN PATENT DOCUMENTS

DE 2446280 4/1975
EP 1 195 725 A2 4/2002
WO WO 98/05006 2/1998

* cited by examiner

*Primary Examiner*—Patrick Mackey
*Assistant Examiner*—Kaitlin S Joerger
(74) *Attorney, Agent, or Firm*—Bacon & Thomas, PLLC

(57) ABSTRACT

The present invention relates to a method and apparatus for processing sheet material, in particular papers of value such as bank notes, checks, etc., wherein different groups of sheet material are processed one after the other, the different groups of sheet material being separated for processing by separation means.

In order to avoid mixing of sheet material, it is provided to restrain the singling of separation means and bank notes until release.

30 Claims, 4 Drawing Sheets

METHOD AND APPARATUS FOR PROCESSING SHEET MATERIAL

BACKGROUND

The present invention relates to a method and apparatus for processing sheet material, in particular papers of value such as bank notes, checks, etc., wherein different groups of sheet material are processed one after the other, the different groups of sheet material being separated for processing by separation means.

In the processing of different groups of bank notes, the different groups of bank notes correspond to deposits by different depositors which are separated by means of separation cards. The separation cards are inserted between the different deposits to separate them. The separation cards can be disposed at the beginning, the end, or the beginning and end of the group of bank notes forming the particular deposit. The separation cards can contain information for example on the depositor and/or the deposit. Further, the separation cards are so designed as to be recognized automatically during processing by the sensors of the bank note processing machine. When a separation card is recognized, the bank note processing machine can enter the associated group of bank notes in the books for the corresponding deposit or corresponding depositor.

The known method has the disadvantage, however, that disturbances and faulty results repeatedly occur during processing of different groups of sheet material despite the design of the separation cards. It is especially problematic that jams or other operating disturbances can result in the bank notes being mixed, i.e. one or more bank notes of one deposit are mixed with bank notes of another deposit in the bank note processing machine. Since the boundaries between different deposits can only be recognized when a separation card is transported through the sensors and recognized, it is not readily possible to avoid mixing since at this time bank notes of the next deposit have normally already been singled and are located in the bank note processing machine. If a disturbance occurs at this time, the bank notes from the two different deposits can no longer be separated so that they cannot be clearly associated with the two different deposits.

SUMMARY

The problem of the present invention is therefore to state a method and apparatus for processing sheet material, in particular papers of value such as bank notes, checks, etc., wherein different groups of sheet material are processed one after the other, the different groups of sheet material being separated for processing by separation means, which allow the different groups of sheet material to be processed without sheet material from different groups of sheet material being mixed.

The invention starts out from the consideration that the singling of separation means and bank notes is restrained until release.

The advantage of the invention is to be seen in particular in that it can avoid e.g. the mixing of bank notes from different groups of bank notes since the singling of separation means and bank notes is always only effected after release.

In a development it is provided that the singling of a recognized separation means is only permitted when the processing of all pieces of sheet material of a previously processed group of sheet material is completely concluded.

The advantage of the development is to be seen in particular in that there can in no case be any mixing of sheet material from different groups of sheet material. This permits the sheet material of each group of sheet material to be always clearly associated with the group of sheet material to which it belongs. Confusion due to faulty processing or disturbances is reliably avoided.

BRIEF DESCRIPTION OF THE DRAWINGS

Further advantages of the present invention can be found in the dependent claims and the following description of examples with reference to figures, in which:

DETAILED DESCRIPTION OF VARIOUS EMBODIMENTS

In the following, the processing of different groups of sheet material will be described by way of example with reference to the processing of different groups of bank notes, to be referred to as deposits in the following. The different deposits are separated from each other by separation means, for example separation cards. A bank note processing machine is used for processing the different deposits.

Figure 1:
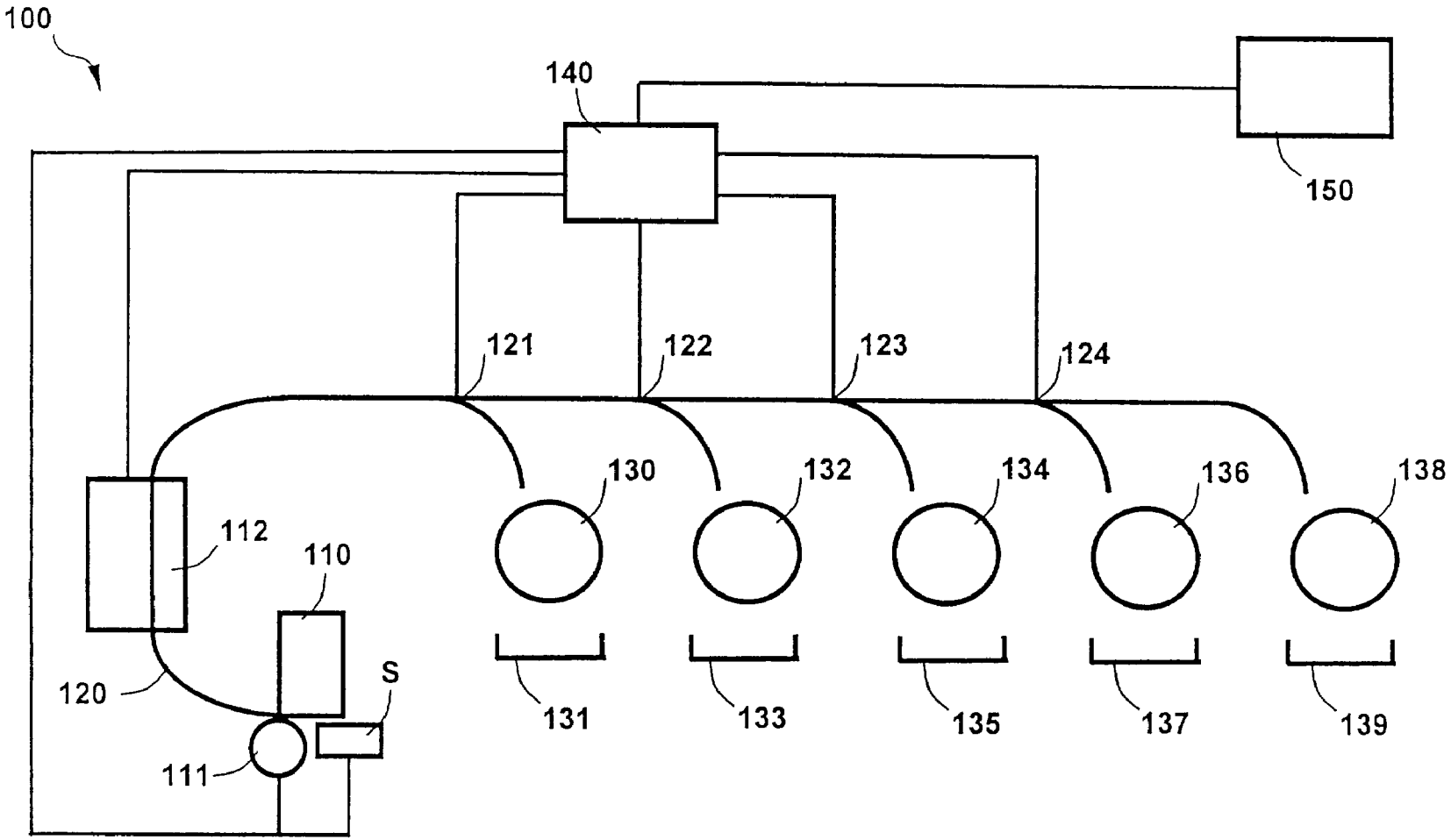
FIG. 1 shows a basic structure of a bank note processing machine for processing different groups of sheet material and avoiding mixing of sheet material from different groups of sheet material in a first embodiment.

FIG. 1 shows a basic structure of bank note processing machine 100 for processing different groups of bank notes or deposits. Bank note processing machine 100 has input unit 110 in which the different deposits are inserted. Input unit 110 is followed by singler 111 which removes single bank notes of the different deposits and the separation cards from input unit 110 and transfers them to transport system 120. Transport system 120 transports the single bank notes and separation cards through sensor unit 112 which determines data from the bank notes that for example permit inferences on authenticity, state, denomination, etc. The separation cards are furthermore recognized in sensor unit 112 and information contained on the separation card detected by sensor unit 112. The determined data of the bank notes and the detected information of the separation cards are transferred to controller 140 which evaluates the data and information, using them to control the further flow of the bank notes and separation cards through bank note processing machine 100. For this purpose, controller 140 acts on diverters 121 to 124, which are elements of transport system 120 and allow the bank notes and separation cards to be deposited in output units 130 to 139 according to predetermined criteria. Output units 130 to 139 can be formed for example as spiral slot stackers which stack the bank notes and separation cards to be deposited in bins 131, 133, 135, 137, 139 by means of rotating units 130, 132, 134, 136, 138 having spiral slots. The operation of bank note processing machine 100 is controlled by means of input/output device 150 having for this purpose e.g. a display and a keyboard.

The separation cards are used, as mentioned above, for recognizing the boundaries of different deposits during automatic bank note processing and for mutually delimiting rejected bank notes, i.e. bank notes classified as false or faulty when checked by sensor unit 112 and controller 140.

The separation cards are vouchers which can be singled, transported and stacked like bank notes in bank note processing machine 100. Their design is such that they can be clearly distinguished from bank notes and therefore recognized by bank note processing machine 100. The separation cards differ from the bank notes to be processed in physical properties such as size, shape and thickness, in their print, in color and pattern or other features such as magnetic areas.

The separation cards are inserted during preparation between the groups of bank notes of the different deposits which are to be separately tested and accounted for. The separation cards can be used as leading cards, i.e. at the beginning of a deposit, or as trailing cards, i.e. at the end of a deposit, or else in combination of these two variants. During preparation, the data of the deposits are normally detected. The deposit data can be present for example in the form of an accompanying slip (delivery note). Said data can be written on by hand or printed on in machine-readable fashion, but they can also be already known because the depositor has reported the data of the deposit by telephone (telebanking) or in another way. Data association is established e.g. by means of a unique mark, e.g. a bar code, on the separation card or information means. In a further case of application it may happen that the value of the deposit is unknown and is to be ascertained only during bank note processing.

Problems in processing different deposits in bank note processing machine 100 occur when bank notes from different deposits are mixed during processing in bank note processing machine 100. This can happen for example when during the singling of bank notes by singler 111 errors occur by which the bank note or separation card singled is not the one properly to be singled next. Further mixing can occur when there is an error in transport system 120, for example a jam of bank notes. When the jam is recognized and bank note processing machine 100 stopped, at least bank notes already singled by singler 111 and transferred to transport system 120 are mixed at the place of the jam, since transport system 120 continues to run for a certain time for reasons of inertia. In this case it is no longer possible to associate the bank notes from different deposits with the deposit to which they actually belong.

In order to avoid such problems, a restraining unit is provided in the area of singler 111 or input unit 110. The restraining unit restrains separation cards from singling and releases them for singling under the control of controller 140. Restraint can be effected in strictly mechanical fashion by blocking separation cards, as explained below in connection with the described embodiments: Alternatively, restraint can be controlled electronically by controller 140 e.g. by means of checking unit S, for example a sensor. When sensor S, which is mounted for example in input unit 110 or on singler 111, recognizes that a separation card is to be singled next, singler 111 is stopped by controller 140. Under the control of controller 140, singler 111 is started again and the separation card and the following bank notes are singled and processed. Hybrid forms are also possible by which the separation card is restrained by both mechanical and electronic means.

Since all deposits are separated by separation cards, the separation cards being disposed at the beginning, the end, or the beginning and end of each deposit, there is always a change from one deposit to another when a separation card appears during processing. At the appearance of a separation card, the processing of the bank notes of the previously processed deposit is ended, i.e. all bank notes located in transport system 120 after their singling are examined by sensor unit 112 and deposited in output units 121 to 139. It can be provided to restrain the separation card for a predetermined time period within which all singled bank notes of the prior deposit can be reliably processed.

It is likewise possible to monitor the progress of processing, e.g. by means of light barriers disposed along transport system 120. When the light barriers report that all singled bank notes are processed, or when the predetermined time period has expired, singling is started again and the recognized separation card and the bank notes of the next deposit are singled. Bank notes of the next deposit are thus only singled and processed in bank note processing machine 100 when no more bank notes of the prior deposit are located in transport system 120 of the bank note processing machine. This avoids the danger of bank notes of the first and second deposits being mixed and makes sure the different deposits are reliably accounted for. The described procedure is repeated when the next separation card is recognized.

So that checking unit S can reliably distinguish separation cards from bank notes, the separation cards must have a feature detectable by checking unit S and not contained in the bank notes. For example it can be provided that the separation card has applied thereto a fluorescent dye which is not used in bank notes. Generally, features are suitable which are used only in separation cards and which cannot be detected by checking unit S through covering bank notes. This ensures that it is always a separation card when the feature is detected.

Further possibilities of recognizing separation cards result from the design of the separation card, i.e. from the choice of its length and/or width and/or thickness and/or shape and/or material. If the design of the separation card deviates clearly from all bank notes to be examined in at least one of these points, reliable recognition of the separation cards is possible.

Figure 2:
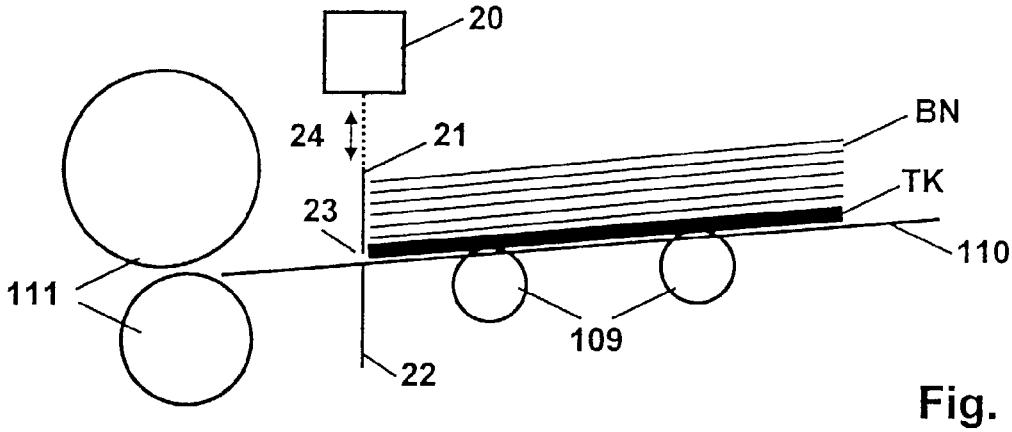
FIG. 2 shows a second embodiment for avoiding mixing of sheet material from different groups of sheet material.

A second embodiment for avoiding mixing of bank notes from different deposits is shown in FIG. 2, the separation cards of this embodiment being thicker than the bank notes to be examined. FIG. 2 shows in more detail the part of bank note processing machine 100 which relates to singling, i.e. input unit 110 and singler 111. Bank notes BN of a deposit to be examined and associated separation card TK lie on input unit 110. The stack of bank notes BN and separation card TK slides over input unit 110 in the direction of singler 111 so that lowermost bank note or separation card TK can be caught by singler 111 and singled. To support the sliding of the stack, driven feed rolls 109 can be provided. In the area before singler 111 there is a restraining unit formed by screen 21, 22 which releases gap 23 which bank notes BN or separation card TK must pass through on the way to singler 111. One part of screen 21 is vertically movable 24 relative to the surface of input unit 110 and is moved by drive 20, for example an electromagnet. In the shown example, the last bank note of a prior deposit has just been singled and separation card TK of the next deposit must be singled next. Since gap 23 is adjusted to a width which only permits the passage of bank notes, separation card TK cannot pass toward singler 111. When the end of processing of the prior deposit is determined, as described above, gap 23 is enlarged by a motion of the driven part of screen 21 so that separation card TK can pass. The width of gap 23 is width of gap 23 is then reduced again for the processing of bank notes BN. At the appearance of further separation card TK (not shown) of a further deposit (not shown) the described process is repeated.

Figure 3:
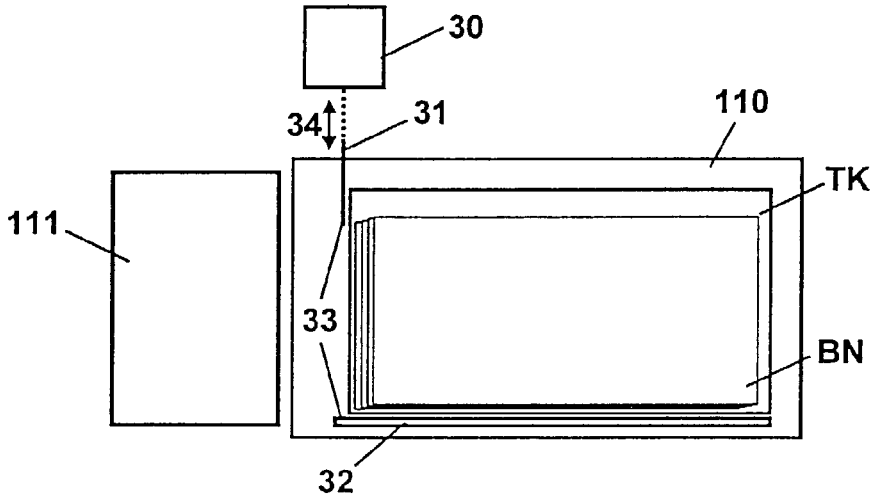
FIG. 3 shows a third embodiment for avoiding mixing of sheet material from different groups of sheet material.

A third embodiment for avoiding mixing of bank notes from different deposits is shown in FIG. 3, the separation cards of this embodiment being wider than the bank notes to be examined. FIG. 3 shows in more detail the part of bank note processing machine 100 which relates to singling, i.e. input unit 110 and singler 111. Bank notes BN of a deposit to be examined and associated separation card TK lie on input unit 110. The stack of bank notes BN and separation card TK slides over input unit 110 in the direction of singler 111 so that lowermost bank note or separation card TK can be caught by singler 111 and singled. In the area before singler 111 there is a restraining unit formed by screen 31, 32 which releases gap 33 which the bank notes or separation card TK must pass through on the way to singler 111. One part of screen 31 is movable in direction 34 spreading the surface of input unit 110 and is moved by drive 30, for example an electromagnet. In the shown example, the last bank note of a prior deposit has just been singled and separation card TK of the next deposit must be singled next. Since gap 33 is adjusted to a width which only permits the passage of bank notes BN, separation card TK cannot pass toward singler 111. When the end of processing of the prior deposit is determined, as described above, gap 33 is enlarged by a motion of the driven part of screen 31 so that separation card TK can pass. The width of gap 23 is then reduced again for the processing of bank notes BN. At the appearance of further separation card TK (not shown) of a further deposit (not shown) the described process is repeated.

Figure 4:
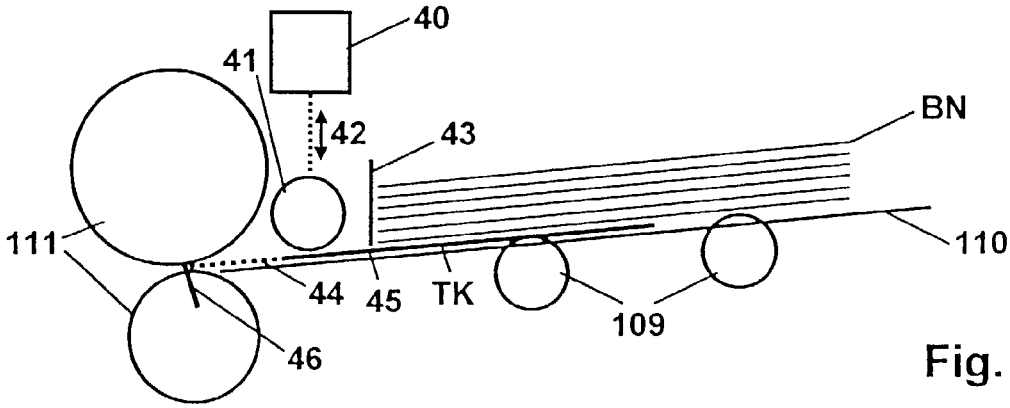
FIG. 4 shows a fourth embodiment for avoiding mixing of sheet material from different groups of sheet material.

A fourth embodiment for avoiding mixing of bank notes from different deposits is shown in FIG. 4, the separation cards of this embodiment having at least one area having a material with a coefficient of friction lower than the coefficient of friction of the bank notes to be examined. FIG. 4 shows in more detail the part of bank note processing machine 100 which relates to singling, i.e. input unit 110 and singler 111. Bank notes BN of a deposit to be examined and associated separation card TK lie on input unit 110. The stack of bank notes BN and separation card TK slides over input unit 110 in the direction of singler 111 so that lowermost bank note or separation card TK can be caught by singler 111 and singled. To support the sliding of the stack, driven feed rolls 109 can be provided. In the area before singler 111 there is screen 43 which releases gap 45 which bank notes BN or separation card TK must pass through on the way to singler 111. In the shown example, the last bank note of a prior deposit has just been singled and separation card TK of the next deposit must be singled next. Since separation card TK has a lower coefficient of friction in at least one area 44 than bank notes BN to be singled, it cannot be caught by singler 111, no singling is effected. When the end of processing of the prior deposit is determined, as described above, additional feed device 41 is moved in direction 42 toward separation card TK, for example by drive 40 formed by an electromagnet. Additional feed device 41 pushes separation card TK into singler 111 so far that separation card TK is caught thereby and singled. Additional feed device 41 is then removed again. At the appearance of further separation card TK (not shown) of a further deposit (not shown) the described process is repeated. In addition to or instead of the described reduction of the coefficient of friction of at least one part of the surface of separation card TK, one can provide restraining element 46, for example a spring element. Restraining element 46 only acts together with separation cards TK, for example because they are wider or stiffer than all bank notes BN to be processed. The singling of separation card TK, i.e. the overcoming of restraining element 46, is only possible when described additional feed device 41 is activated.

Figure 5A:
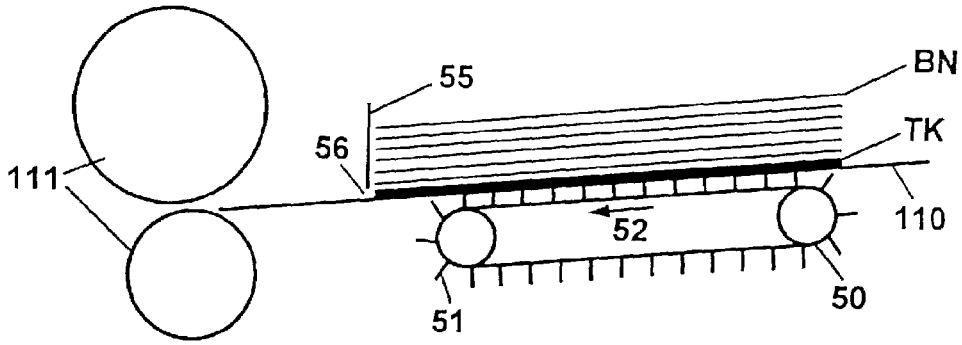
FIG. 5 shows a fifth embodiment for avoiding mixing of sheet material from different groups of sheet material.
Figure 5B:
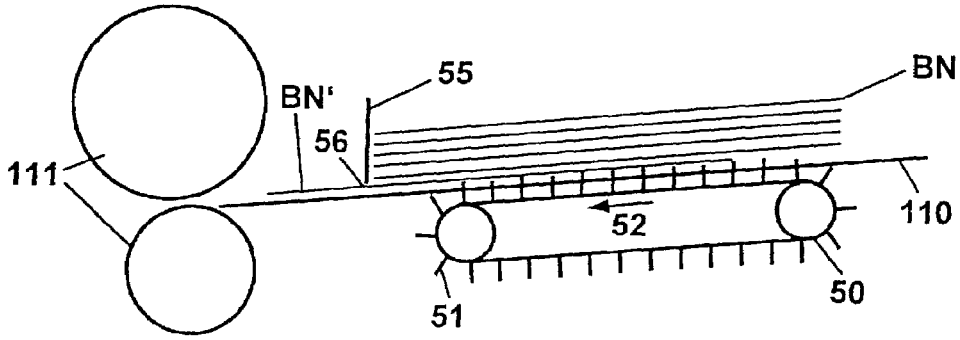
Figure 6:
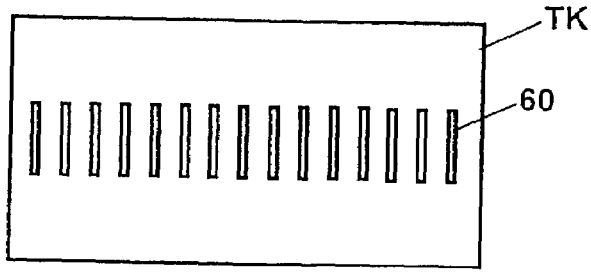
FIG. 6 shows a separation means for the fifth embodiment for avoiding mixing of sheet material shown in FIG. 5.

A fifth embodiment for avoiding mixing of bank notes from different deposits is shown in FIG. 5, the separation cards of this embodiment having a perforated area. Such a separation card TK with perforations 60 is shown by way of example in FIG. 6. FIG. 5 shows in more detail the part of bank note processing machine 100 which relates to singling, i.e. input unit 110 and singler 111. FIG. 5*a* shows the state in which separation card TK is to be singled next and thus marks the change to a new deposit of bank notes BN. Conveyer belt 50 reaches with elevations 51 through the support of input unit 110, elevations 51 being formed so as to be spaced apart the same distance as perforations 60 (FIG. 6) and thus engage separation card TK. Separation card TK is thus held by conveyer belt 50 when the latter is not moved. Gap 56 formed by screen 55 is blocked by separation card TK; bank notes BN located above separation card TK cannot be singled. When the end of processing of the prior deposit is determined, as described above, conveyer belt 50 is set in motion in direction 52. Separa-Separation card TK is thus moved into the area of singler 111 and singled. Now gap 56 is released, as shown in FIG. 5*b*, and first bank note BN' of bank notes BN of the next deposit is singled. For this purpose, conveyer belt 50 can be driven further in direction 52 so that elevations 51, which can have for example friction elements disposed at their ends, transport the bank notes toward the singler When a separation card is recognized again, e.g. by sensor S, conveyer belt 50 is stopped and the described procedure is repeated. It can also be provided, however, that conveyer belt 50 is only driven when separation card TK is to be supplied to singler 111. Bank notes BN then slide over the ends of elevations 51, which in this case have low friction. In a further variant, conveyer belt 50 or its elevations 51 are only in the area of the input unit if separation card TK has been recognized. If bank notes BN are present, conveyer belt 50 or its elevations 51 are removed from the area of input unit 110 so that bank notes BN can pass through gap 56 without any problem.

Figure 7:
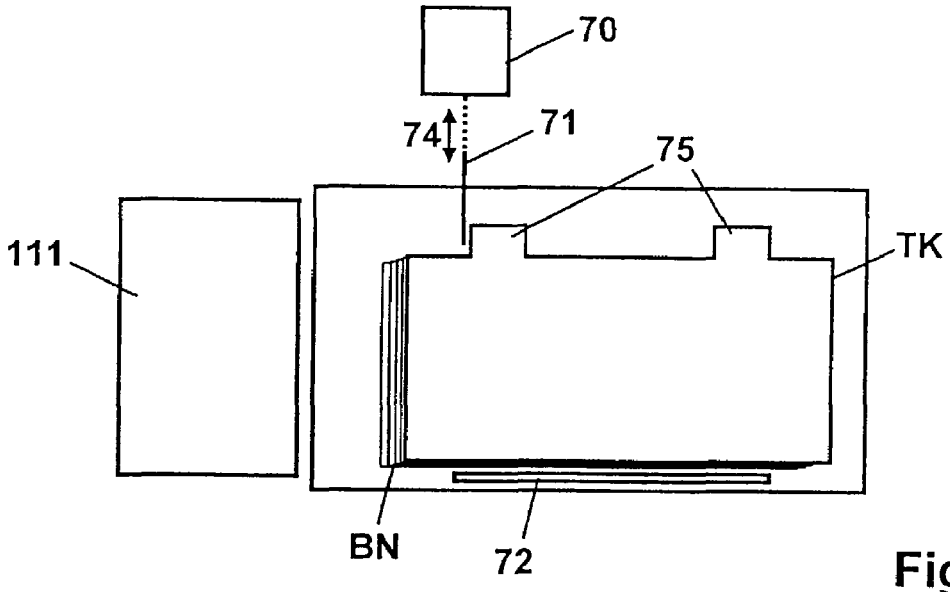
FIG. 7 shows a sixth embodiment for avoiding mixing of sheet material from different groups of sheet material.

A sixth embodiment for avoiding mixing of bank notes from different deposits is shown in FIG. 7, the separation cards of this embodiment having tabs or projections 75. FIG. 7 shows in more detail the part of bank note processing machine 100 which relates to singling, i.e. input unit 110 and singler 111. Bank notes BN of a deposit to be examined and associated separation card TK lie on input unit 110. The stack of bank notes BN and separation card TK slides over input unit 110 along stop 72 in the direction of singler 111 so that lowermost bank note BN or separation card TK can be caught by singler 111 and singled. In the area before singler 111 there is screen 71 which tabs 75 of separation card TK must pass through on the way to singler 111. Screen 71 is movable 74 in a direction spreading the surface of input unit 110 and is moved by drive 70, for example an electromagnet. When separation card TK is to be released for singling, screen 71 is moved by drive 70 so that tab 75 of separation card TK is released and separation card TK can pass through. The screen is then moved back into the shown position. At the appearance of further separation card TK (not shown) of a further deposit (not shown) the described process is repeated.

Figure 8:
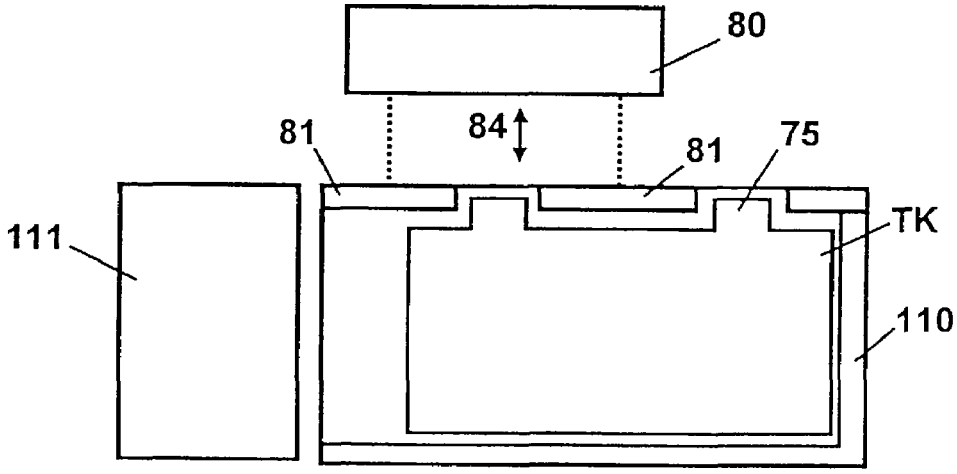
FIG. 8 shows a seventh embodiment for avoiding mixing of sheet material from different groups of sheet material.

A seventh embodiment for avoiding mixing of bank notes from different deposits is shown in FIG. 8, this being a variant of the sixth embodiment. The separation cards likewise have tabs or projections 75. However, input unit 110 is formed as a container, in particular a security box, in which the deposits, i.e. bank notes BN and sepa-separation cards TK, are stored in stacked fashion. The container and singler 111 are so designed that bank notes BN and separation cards TK can be removed from the container for singling. All bank notes BN to be examined can readily be singled by singler 111. However, separation cards TK lock with their tabs 75 into gaps of the container so that singler 111 cannot single them. The container has areas 81 which can be moved by drive 80, e.g. an electromagnet, in direction 84 so as to release particular separation card TK to be singled or its tabs 75. Areas 81 of the container are then moved back into the shown position. At the appearance of further separation card TK (not shown) of a further deposit (not shown) the described process is repeated.

Instead of the described checking of separation cards TK by sensor S, the restraint can also be realized so that the mechanical restraint used always prevents the singling of separation cards in normal operation, as can be the case for example in the embodiments according to FIGS. 2 to 8. When the time required for processing all singled bank notes of a prior deposit has expired, or when the light barriers report the end of processing, screens 21, 31, 71 (FIGS. 2, 3, 7) or areas 81 of the container (FIG. 8) or conveyer belt 50 (FIG. 5) or additional feed device 41 (FIG. 4), for example, is actuated in order to move then present separation card TK into the catching area of singler 111. If no separation card TK is present any more, because all deposits to be processed were previously processed, processing is ended. This procedure has the advantage that no active recognition of separation cards by a sensor is necessary.

As described above, deposits can be delimited from each other by separation cards disposed as leading, trailing, or leading and trailing separation cards. When leading or trailing separation cards are used, the boundary can always be recognized by the appearance of a separation card. However, if leading and trailing separation cards are used simultaneously, it can be provided to single the first recognized separation card since it is the trailing separation card of the deposit just processed. If a further separation card is recognized immediately after that, stopping is effected since this is the leading separation card of the next deposit. Likewise, at the beginning of processing (first deposit to be processed) the first separation card can be immediately singled if it is a leading separation card. At the end of processing (last deposit to be processed), the last separation card can be immediately singled if it is a trailing separation card.

The above-described embodiments are suitable for application in bank note processing machines wherein bank notes are singled, transported and processed along their long sides, as shown. They are likewise suitable for bank note processing machines wherein bank notes are singled, transported and processed along their short sides. It is further possible to mix the orientation of the bank notes during singling, transport and processing.

Deviating from the shown arrangement of singler 111 and input unit 110 whereby the lowermost bank note or separation card is singled, arrangements are possible whereby the uppermost bank note or separation card is singled.

Further, the embodiments described separately in particular above can be combined at will.

If the singling of a separation card has erroneously not been prevented, e.g. because a separation card was caught by singler 111 in a multiple removal together with one or more bank notes, or because impermissible singling was effected for other reasons, it can be provided that further processing is stopped upon recognition of a separation card by sensor unit 112. In particular, singler 111 is stopped by controller 140. If it is determined, as described above, that the bank notes of the prior deposit have been processed completely, processing is continued by the control of controller 140.

The invention claimed is:

1. A method for processing sheet material, wherein different groups of sheet material separated by at least one separator are processed one after the other, the sheet material and the separator being singled to permit each piece of sheet material and each separator to be processed singly, the method comprising the steps of restraining from singling and then releasing for singling each separator and at least the associated group of sheet material;

wherein the at least one separator is individually distinguishable and separate from the sheet material.

2. The method according to claim 1, wherein the release for singling of the separator and the associated group of sheet material is effected when the processing of all pieces of sheet material of a previously processed group of sheet material is completely concluded.

3. A method according to claim 1 wherein each separator is restrained mechanically.

4. The method according to claim 1, wherein the restraint is effected on the basis of a different size of the separator and the sheet material to be processed.

5. The method according to claim 1, wherein the restraint is effected on the basis of a different thickness of the separator and the sheet material to be processed.

6. The method according to claim 1, wherein the restraint is effected on the basis of a different roughness of the separator and the sheet material to be processed.

7. The method according to claim 1, wherein the restraint is effected on the basis of a different shape of the separator and the sheet material to be processed.

8. The method according to claim 7, wherein each separator has a shape including perforations and/or tabs.

9. The method according to claim 1, wherein it is checked before each singling whether a separator is to be singled next.

10. The method according to claim 9, wherein the check for presence of a separator is a check of the size of the object to be singled next.

11. The method according to claim 9, wherein the check for presence of a separator is a check of the thickness of the object to be singled next.

12. The method according to claim 9, wherein the check for presence of a separator is a check of the roughness of the object to be singled next.

13. The method according to claim 9, wherein the check for presence of a separator is a check of the shape of the object to be singled next.

14. The method according to claim 13, wherein each separator has a shape including perforations and/or tabs.

15. The method according to claim 9, wherein the check for presence of a separator comprises an optical and/or magnetic check of the object to be singled next.

16. The method according to claim 1, wherein singling is stopped in order to restrain the separator.

17. An apparatus for processing sheet material, having an input unit for receiving different groups of sheet material separated by at least one separator in order to be processed one after the other, a singler for singling sheet material and each separator in order to transfer each piece of sheet material and each separator singly to a transport system for guiding the bank notes and separators through a sensor unit and supplying them to output units under the control of a controller which evaluates the signals of the sensor unit, said apparatus further comprising a restraining unit located before the singler and arranged to restrain each separator and at least the following group of sheet material from singling and to release them for singling under the control of the controller;

wherein the at least one separator is individually distinguishable and separate from the sheet material.

18. The apparatus according to claim 17, wherein the restraining unit is disposed in the input unit.

19. The apparatus according to claim 17 wherein the controller is arranged so as to monitor whether the processing of all pieces of sheet material of a previously processed group of sheet material is completely concluded, and wherein the restraining unit is arranged so as to release the singling of separators by the singler after the controller has ascertained complete processing.

20. The apparatus according to claim 17, wherein the re straining unit includes a device arranged to mechanically restrain at least one separator and to release it for singling by the singler.

21. The apparatus according to claim 20, wherein the device is arranged to restrain and release the separator on the basis of its shape and/or size and/or thickness.

22. The apparatus according to claim 21, wherein the shape of the separator includes perforations and/or tabs.

23. The apparatus according to claim 20, wherein the restraining unit is arranged to restrain and release the separator on the basis of its roughness.

24. The apparatus according to claim 17, wherein the restraining unit includes a checking unit, including a sensor, arranged to check whether a separator is to be singled next.

25. The apparatus according to claim 24, wherein the sensor is arranged and configured so as to check properties selected from the group consisting of optical, electrical and magnetic.

26. The apparatus according to claim 17, wherein for restraining the separator the controller 140 is arranged to stop the singler at the presence of a separator.

27. The apparatus according to claim 17, wherein the sensor unit and the controller are arranged to check whether a separator is present.

28. The apparatus according to claim 27, wherein during processing of a group of sheet material the controller is arranged to interrupt processing, in particular by stopping the singler, if the sensor unit and the controller determine the presence of a separator.

29. The method according to claim 1, wherein the at least one separator has physical, optical, electrical or magnetic properties different from the sheet material of a respective group.

30. The apparatus according to claim 17, wherein the at least one separator has physical, optical, electrical or magnetic properties different from the sheet material of a respective group.

* * * * *